United States Patent [19]

Rivers

[11] Patent Number: 4,812,045

[45] Date of Patent: Mar. 14, 1989

[54] GYPSUM DISSOLUTION SYSTEM

[75] Inventor: Jerry B. Rivers, Visalia, Calif.

[73] Assignee: Domtar Gypsum Inc., Oakland, Calif.

[21] Appl. No.: 87,695

[22] Filed: Aug. 20, 1987

[51] Int. Cl.[4] ..... B01F 13/02

[52] U.S. Cl. ..... 366/107; 366/137; 366/153; 366/191; 366/348

[58] Field of Search ..... 366/2, 3, 13, 40, 191, 366/64, 66, 151, 94, 95, 156, 167, 168, 191, 194, 136, 137, 153, 163, 262, 348, 101, 107; 137/896–898, 192, 395, 268; 47/58, 1 R

[56] References Cited

U.S. PATENT DOCUMENTS

| | | |
|---|---|---|
| 1,992,261 | 2/1935 | Traudt . |
| 2,613,922 | 10/1952 | Gatchet . |
| 2,626,482 | 1/1953 | Munday et al. . |
| 2,751,335 | 6/1956 | Carver et al. . |
| 2,756,544 | 7/1956 | Rosgen . |
| 2,760,820 | 8/1956 | Cirese . |
| 2,908,111 | 10/1959 | Hazen et al. . |
| 3,233,874 | 2/1966 | Betulius . |
| 3,570,508 | 3/1971 | Boggs et al. . |
| 3,607,105 | 9/1971 | Reid et al. . |
| 3,777,003 | 12/1974 | Mitterer . |
| 4,397,561 | 8/1983 | Strong et al. . |
| 4,616,579 | 10/1986 | Solt . |

OTHER PUBLICATIONS

Brochure "SDI Turf Sprayers", SDI Spraying Devices, Inc., P.O. Box 3107, Visalia, CA 93278.

*Primary Examiner*—Timothy F. Simone

*Attorney, Agent, or Firm*—Burns, Doane, Swecker & Mathis

[57] ABSTRACT

A continuous precess and apparatus for preparing a gypsum slurry of water and finely divided high purity gypsum for use in an irrigation system wherein the gypsum and water are mixed by vigorous agitation in a tank or the like. Means are provided to create a quiescent zone in the tank that extends from at least the mid-section of the tank to the upper region thereof for discharge of the slurry so that agitation of the slurry mix within the tank does not interfere with an even discharge of the slurry from the tank.

11 Claims, 3 Drawing Sheets

GYPSUM DISSOLUTION SYSTEM

Figure 1:
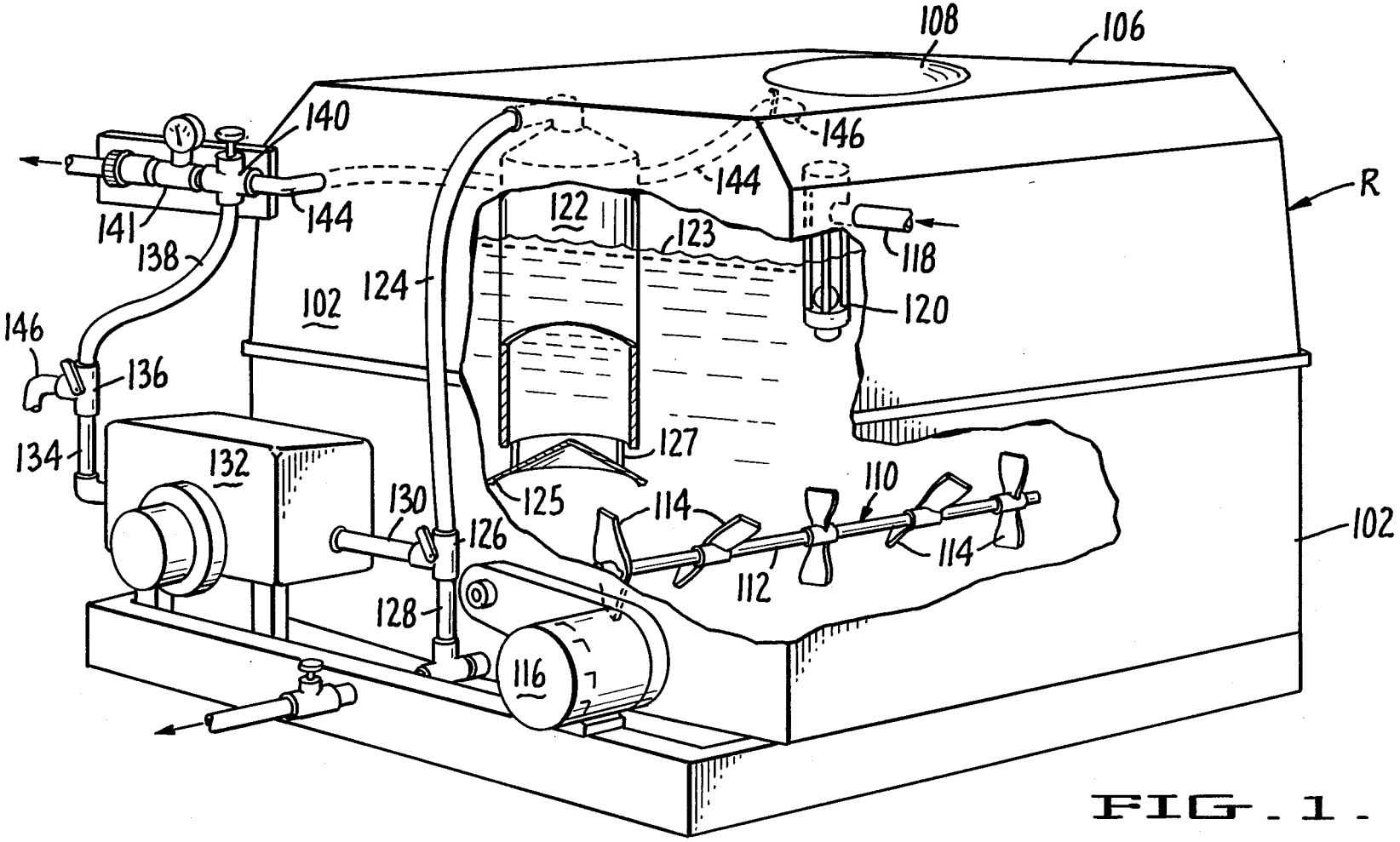

This invention relates to the dissolution of granular and powdered gypsum in water for use as a fertilizer, and particularly as a soil penetrating agent, and to the apparatus and process for preparing the gypsum solution.

PURPOSES OF THE INVENTION

The purpose of the invention is to continuously prepare a gypsum solution for use in the irrigation of plants on farms and ranches, including orchards and vineyards, where periodic irrigation is required and where moisture penetration in dry soils is essential. Accordingly, it is proposed to mix relatively high-purity gypsum in water. Such gypsum should have a minimum of insolubles and is desirably of high purity and small particle size. The mixing of the water and gypsum must be sufficiently vigorous to enable the gypsum and water to form a slurry and for gypsum to commence to dissolve therein. The slurry and gypsum solution is then introduced into the irrigation system wherein it is, for all practical purposes, completely dissolved before it reaches the outlet nozzles which spray the area to be irrigated. The mixing by vigorous agitation in the tanks may be by mechanical stirring or hydraulically by jets and the like which aid in recirculation of the slurry.

A finely ground, high purity gypsum is essential for the process of this invention. The gypsum must be of a particle size of at least −100 mesh, and the purity should be 90% or over and preferably at least about 92%. The foregoing particle size and purity are essential to effectively operate a continuous process where agitation of the ground gypsum and water will occur at rates that will supply sufficient dissolved gypsum to the area to be irrigated without the flow thereof being hampered by insolubles, such as particles of silica that would clog or otherwise interfere with flow through the system.

The invention also includes certain of the equipment for carrying out the process for mixing the gypsum and water and for pumping it to a conventional irrigation system, wherein it is completely dissolved prior to discharge or the particle size of the solids are so small as to readily pass through the system and be effective, on the plants to be irrigated to thus carry out the moisture penetrating objective of the invention and at the same time provide mineral content for the soil.

In an advantageous embodiment of the apparatus of the invention, a self-contained tank unit is provided which contains all of the essential apparatus necessary for carrying out the process, including if desired, the pumps utilized in the system for blending and recirculation of water and discharge of the slurry.

PRIOR ART AND ITS DEFECTS

It has been proposed heretofore to mix gypsum and other fertilizer materials with water and form solutions thereof for various purposes, including fertilizing plants and trees. However, these systems have not been particularly successful because the gypsum has been of a grade that does not completely dissolve into a water slurry that penetrates deeply into the soil and thus they have failed to achieve the advantages of the present invention of complete dissolution which is essential to obtain optimum results.

In like manner, the equipment provided in the prior art has not been sufficient to prepare solutions of relatively pure gypsum without measurable solids, including insoluble impurities, of a size that otherwise would clog mixing, agitating and circulating equipment, including pumps and spray nozzles. The prior art processes have limited application in contrast to the present situation.

DESCRIPTION OF THE INVENTION

The present invention and its advantages can be more readily understood by reference to the detailed description thereof which is set forth hereinbelow.

Figure 2:
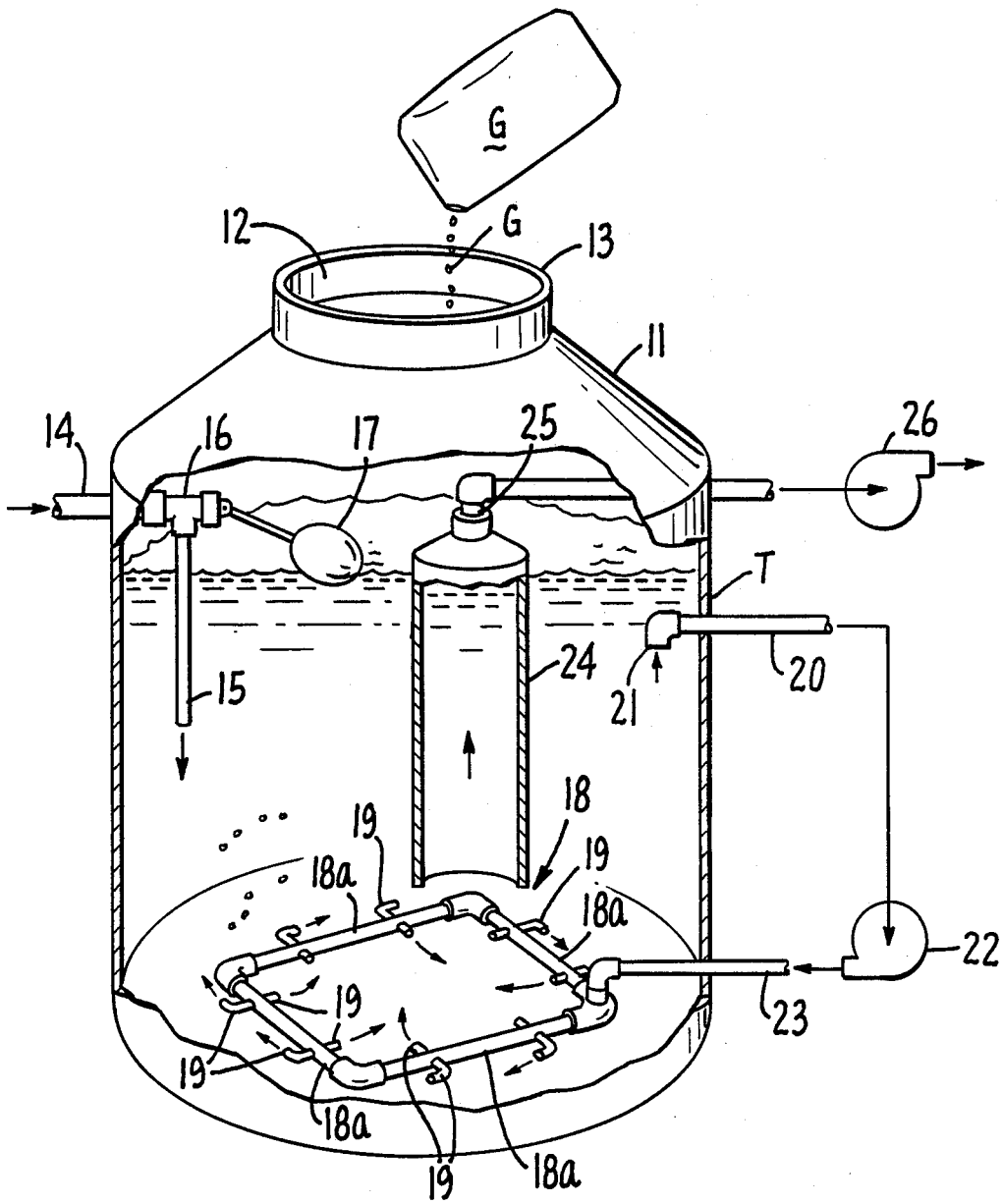

In the drawings:

FIG. 1 is a front elevation of the tank of the invention with a substantial portion of the tank wall broken away and showing in perspective and partly in section mechanical agitation means for mixing gypsum and water therein; and FIG. 2 is a perspective view of another form of tank useful in carrying out the invention using hydraulic mixing means in the form of jets and has a substantial portion of the mixing tank walls broken away to show certain of the essential features of the equipment partly in section and partly in outline.

Figure 3:
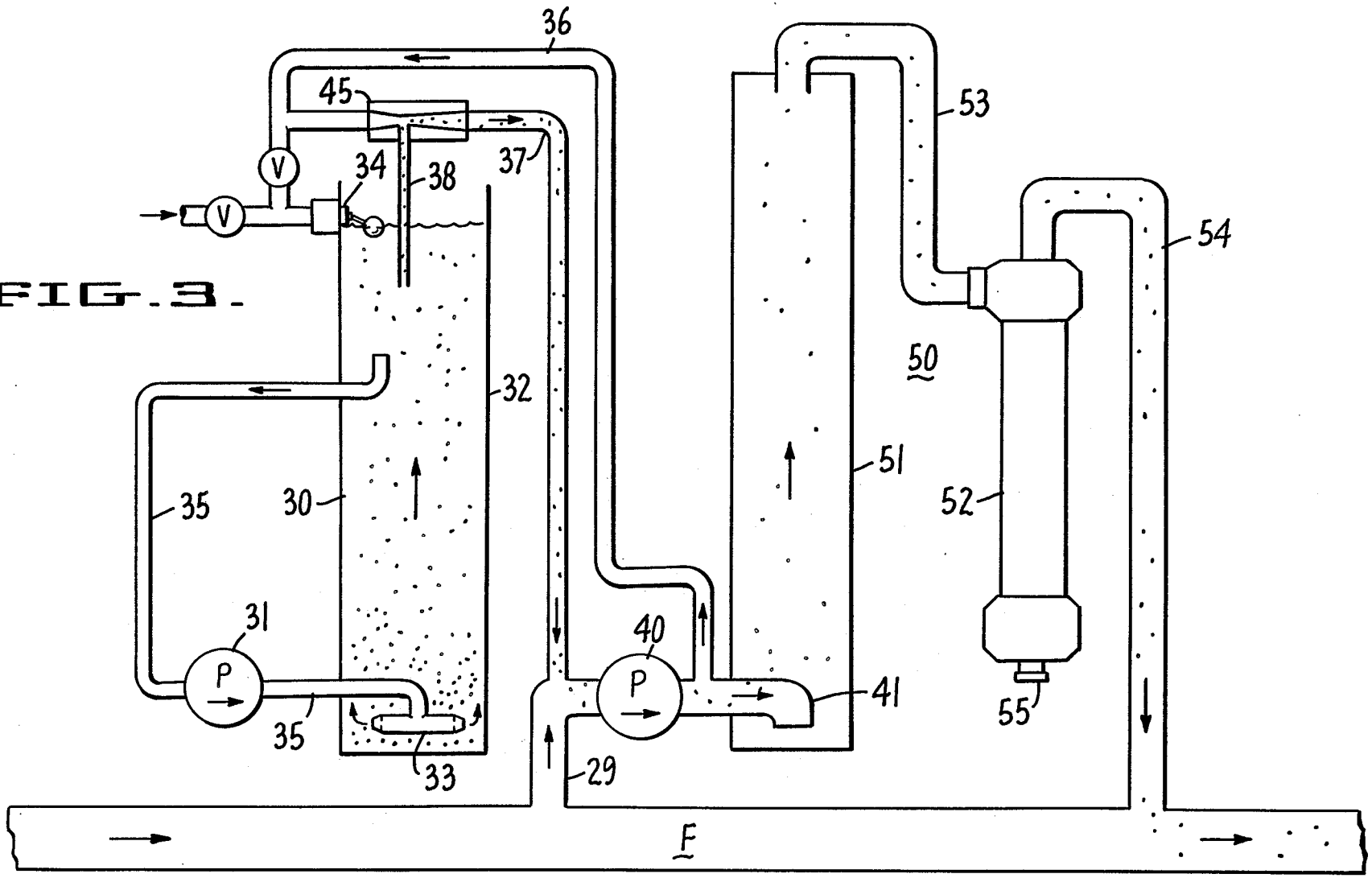

FIG. 3 is a schematic diagram of the flow path of another useful hydraulic mixing embodiment of the invention showing the interior tank and certain of the equipment therein.

A preferred embodiment of the invention is disclosed in FIG. 1 hereof, which is to a generally rectangular tank R of any convenient size to hold a sufficient quantity of water and gypsum for continuous dissolution of the gypsum and formation of a slurry. Tank R may be made of any satisfactory corrosion-resistant material. Glass fiber is a particularly advantageous material because of its resistance to corrosion and relatively light weight. For convenience tank R and the equipment shown therein and mounted thereon can be mounted on a mobile unit or platform of any conventional design (not shown) and moved as required in normal use.

The tank in FIG. 1 includes upright sides and ends 102 with a top portion 106 having opening 108 through which granular or powdered gypsum may be fed. Opening 108 normally is covered when the tank is in use.

Located at the base of tank R is an agitator system 110 comprising horizontally disposed shaft 112 and agitator blades 114. The number of blades 114 depends on the length and size of the tank and an advantageous arrangement includes five blades, each directed and arranged to propel the components of the tank flow against each other. An electric motor or gasoline engine 116 is provided to actuate agitator system 110 and rotate shaft 112 and blades 114. By appropriate pulley and belt arrangements (not shown) motor 116 can be used to actuate diaphragm pump 132 as well as agitator shaft 112.

Water is introduced into the tank at opening 118 desirably in the top portion thereof. A float level control means 120 is provided in the upper region of tank R to maintain the level of the water at the desired point 123 for continuous operation. An extractor 122 is also provided at the top of the tank and extends downward to the lower region of the tank. A generally conical deflector 125 is positioned below and spaced from extractor 122 and is held in place by struts 127 or any other means that will hold it in a fixed position. The purpose of the deflector 125 is to assure an even flow of the gypsum slurry into the quiescent zone of extractor 122 and prevent the agitation of the slurry from the mixing apparatus from surging into the outlet or discharge systems and affecting the quiescent zone therein. Slurry and dissolved gypsum may be withdrawn from tank R through line 124 extending from the top of extractor 122. The slurry then passes through T-valve 126 as it is withdrawn from extractor 122.

As it is withdrawn from extractor 122, it passes through line 130 into diaphragm pump 132, which in turn pumps water through line 134, T-valve 136 and on through line 138 and through pressure regulator 140. The gypsum slurry and solution of dissolved gypsum can in part be sent through a flow regulator 141 on the main irrigation system and in part returned through line 144 to the tank R for recirculation. Outlet 146 may be placed in any convenient area of the tank. In one arrangement, a 6-gallon per minute flow occurs wherein one gallon per minute is returned to the main irrigation system and 5-gallons per minute are returned to tank R for recirculation.

In the event of an accumulation on the floor of tank R of insolubles and large particles of undissolved gypsum so as to make it useful and advisable to clean the system, valve 126 can be adjusted as well as valve 136, so that upon actuation of pump 132 and motor 116 the impeller blades 114 act to pump to waste the undesirable materials through at line 146 leading from valve 136.

A desirable embodiment of the apparatus for carrying out the present invention is disclosed in FIG. 2 hereof wherein tank T is the vessel wherein the mixing of the gypsum and water takes place. Tank T is a cylindrical vessel having a frusto-conical upper section 11 with an opening 12 having upright wall 13 at the top thereof for feeding gypsum powder G. Tank or vessel T, as in the case of tank R of FIG. 1, may be made of any satisfactory material which is water-tight and not likely to corrode or disintegrate. A heavy walled plastic of polyvinyl chloride is desirable because of its light weight and consequent ease of mobility. Water intake system 14 leading to outlet 15 adjacent the bottom of tank T and passing through T-connection 16, is used to introduce water to the system. Adjacent to T-connection 16 is float valve 17 of conventional design which controls the flow of water and is used to maintain the water at a pre-determined level as shown in FIG. 2. Other arrangements for controlling the water level within the tank may be used so long as they perform the functions of valve 17.

At the base of tank T is a pipe system 18 comprising a plurality of conduits 18a interconnected with each other and each having one or more jet spray nozzle outlets 19. Pipe 20 is located adjacent the side of tank T and at a point desirably in the upper level of tank T and well above the outlet 15 through which incoming water is supplied. Pipe 20 has an inlet 21 through which part of the gypsum slurry mix within the tank may be withdrawn by the action of pump 22 outside of tank T. Water received through opening 21 is recirculated and pumped back into tank T through pipe 23, into the piping conduit 18 and through jet sprays 19 in the base of the tank.

An extractor tube 24 is situated in the upper portion of the tank T and is arranged so that it extends well into the tank solution. Situated in the center of the extractor tube 24 at its top, is an outlet pipe 25 which continues upward and then to the outside of the tank T. It is arranged to work in conjunction with pump 26, also located outside of the tank. When it is energized pump 26 causes the gypsum slurry to flow upward and out of the tank through pipe 25 as described herein in more detail. A deflector (not shown) similar to conical deflector 125 of FIG. 1 may also be used with extractor tube 24, if so desired.

In the operation of the system of FIG. 2, water is introduced into tank T through the piping system 14 and 15 until the water in the tank reaches the desired level and float valve 17 operates to stop the flow of water or adjust it to permit make-up water to enter as required during the operation. Pump 22 is then energized and the water pressure created thereby projects jets of water through the bottom region of tank T. These jets cause the vigorous agitation and violent circulation of water in the tank.

Agricultural grade gypsum is introduced through opening 12 at the top of tank T. The agitation and circulation of water in the tank, due to the action of the jets, reduces the size of the gypsum particles and causes some of them to actually go into solution while forming a slurry with the remainder thereof. As the tank is fully charged with the desired amount of gypsum, for example in a tank of the embodiment of FIG. 2 that contains 350 gallons of water, it is possible to charge about 1,000 pounds of agricultural grade gypsum. When the tank is thus fully charged, the extractor pipe system 25 and pump 26 are activated and a concentrated gypsum slurry is drawn from the tank through extractor tube 25 located within extractor sleeve 24.

The length and diameter of sleeve 24 is important because it has the effect of regulating the size of the particles which will be withdrawn from the tank while giving the mixture of gypsum and water a calm residence period for moving up through sleeve 24 into withdrawal tube 25. It is to be noted that the longer the period of travel through the extractor sleeve may be, as well as the greater the diameter and length thereof, as well as the speed at which the slurry is withdrawn, the smaller are the particles which are withdrawn. The gypsum slurry is delivered to an irrigation receiver where it completely dissolves in the excess water to provide treated irrigation water of a desired and controlled concentration. The slurry is then delivered to a drip irrigation receiver or otherwise injected into the irrigation system on the intake side of a drip irrigation pump or injected into the pressure side of an irrigation system, as the system design dictates.

Any fine partices of insolubles that are in the slurry are of a size that readily pass through the jet spray nozzles and into the system without any clogging or plugging of the jet spray nozzles or of the drip irrigation pipes, or the like. In the rare instance where there may be an insoluble piece, it will be caught in the filter within the system before it reaches the spray nozzles.

The foregoing description of the operation and significance of the sleeve or extractor applies also to the embodiments of the invention shown in FIG. 1 and FIG. 3 wherein the extractor is equally important.

Another advantageous embodiment of the invention is shown in FIG. 3 in schematic form. It comprises a gypsum dissolution system 50 and a gypsum slurry system 30. The slurry system 30 includes pump 31, a tank 32, jet agitator assembly 33, and conventional float valve assembly 34 which latter assembly is in the upper region of tank 32. Pipe 35 is located in the mid-to-upper section of tank 32 and leads to pump 31 which in turn is in communication with the jet assembly 33 at the bottom of tank 32.

Dissolution system 50 includes a dissolution tank 51 and a centrifugal filter system 52. Pump 40 is positioned between slurry system 30 and dissolution system 50. As will be noted, water from irrigation system F flows through pipe 35 and is in communication with pipes 36 and 37 connected to tank 32 through overflow valve 34 and upper intake sleeve or pipe 38 at the top of tank 32. A discharge pipe 41 is further provided to permit flow into slurry tank 51. At the top of tank 51 is discharge pipe 53 leading to centrifugal filter 52 which is adapted to discharge through pipe 54 back into the main irrigation pipe F.

In operation, pump 40 pulls water from main irrigation flow F and causes it to flow through tank 51, centrifugal filter 52 and back into the main irrigation flow through pipi 54. At the same time, water is supplied by differential pressure to the injection device 45 shown above tank 32. The dilute gypsum slurry is thus injected into the intake side of pump 40 which in turn enables the water and part of the gypsum slurry to flow into and through line 37 back into tank 32 which flow is also through float valve 34. The dilute gypsum slurry injected into the dissolution system 50 mixes with the water being pulled from the main irrigation water flow F by pump 40 and flows into tank 51 where gypsum dissolution occurs. The slurry then passes to filter 52 wherein insoluble materials are separated and then removed at purge 55. The slurry is then sent on the flow pipe F of the irrigation system. Insoluble materials settle to the bottom of filter 52.

The apparatus as disclosed in the accompanying drawings and described herein may be modified as desired by the operator to suit the needs of a particular situation.

Although the foregoing embodiments of the invention disclosed in FIG. 1, FIG. 2, and FIG. 3, respectively, are satisfactory methods of carrying out the process of this invention, the embodiment shown in FIG. 1 is preferred.

By the present invention the amount of gypsum introduced into the irrigation water by any of the systems can be readily controlled. Any type of gypsum that will dissolve in water is useful in the system of the invention, however, a gypsum of relatively small particle size and high purity is desirable because of its ready solubility and reduced amount of impurities and insolubles. For example, a gypsum of about 95% purity having a paritcle size wherein 95% thereof will pass a 100 mesh screen.

One of the advantages of the invention is that only relatively small amounts of gypsum need be added to the water. For example, in a system pumping 240 gallons per minute of water, only one gallon of water per minute need be withdrawn from the irrigation system for use in the mixture to obtain the results achieved under the invention. However, the ratio of water withdrawn from the irrigation system and that used in the mixing systems disclosed herein to the total water in the irrigation system may range from a minimum of less than 1 gpm withdrawal for mixing to an amount that is considerably greater so long as the gypsum will totally dissolve prior to discharge from the sprinklers.

The system of FIG. 2, e.g., may range from a minimum of 2 milliequivalents of gypsum per liter of water to a maximum of 28 milliequivalents of gypsum per liter of water is the operating range of gypsum additions to the system. The amount of 5 milliequivalents gypsum per liter is the preferred rate of operation. The capacity of a system would vary from site to site and may well range from 5 gpm to 3500 gpm as measured after mixing the dissolved gypsum with the irrigation system following the dissolution step.

In one instance, in an orchard in the San Joaquin Valley of California, where irrigation must be relied upon because of the established weather pattern that includes a prolonged dry period each year running from late spring through the summer and the early fall, successful field trials have been conducted. Such an orchard is characterized by the inability of irrigation water to penetrate the soil to a depth sufficient to properly irrigate the tree root with resultant poor yields as to quantity and quality of the fruit grown on the trees. The following illustration of the practice of the form of this invention as shown in FIG. 3 relates to a system wherein the depth of irrigating water penetration in the orchard was markedly increased while the mineral content of the irrigating water was substantially raised.

A 40-acre grove of Valencia orange trees in such orchard was divided into two 20-acre blocks by a drainage ditch running between them. The irrigation system was arranged to deliver six gallons of water per hour to each tree through two sprinklers. Each block was planted with 120 trees resulting in a water application rate of 14,400 gallons per hour to each 20-acre block. The typical irrigation cycle was 24 to 48 hours. Total irrigation per year in such a range is approximately 900 hours or 24 inches of water per acre, amounting to 2 acre feet.

One of the 20-acre blocks was designated as the treated block and another was designated as the untreated block. In the treated block 56 trees were supplied with treated water by the gypsum system of the present invention. The balance of the irrigating water was distributed over the remaining 20-acre block, thus the latter block received only untreated water. Water infiltration was determined generally by inserting a 5/16-inch pointed rod into the soil; which rod easily penetrated wet soil, but did not penetrate dry soil. Soil samples were taken for verification by the use of a soil sampler comprising a bucket auger. Also, samples were taken with the standard ¾-inch core sampler which gave similar results. Actual measurement of soil moisture lost in oven drying is one of the most reliable methods of determining actual soil moisture and also was used in the test described below to determine the existing available moisture percentage.

In the test results below, the treated block of 56 trees that received 132.5 hours of irrigation with treated water, which is equivalent to 795 gallons per tree at a concentration of 5 meq/l. Such treated water supplied 2.85 pounds of dissolved gypsum to each tree. By that system, the following results were obtained which clearly show, particularly at the 24 inch and deeper level, that marked moisture penetration was recovered.

TABLE

SOIL MOISTURE

| Description | Depth | Saturation % | Moisture Content % | Available Moisture % |
|---|---|---|---|---|
| Treated | 0–12" | 27.0 | 12.38 | 83.4 |
| R2 T4–5 | 12–24" | 27.0 | 11.48 | 70.1 |
| | 24–36" | 28.0 | 9.24 | 32.0 |
| Treated | 0–12" | 26.0 | 13.84 | 112.9 |
| R3 T7–8 | 12–24" | 32.0 | 16.52 | 106.5 |

TABLE -continued

SOIL MOISTURE

| Description | Depth | Saturation % | Moisture Content % | Available Moisture % |
|---|---|---|---|---|
| | 24–36" | 32.0 | 13.10 | 63.8 |
| Treated | 0–12" | 29.0 | 15.51 | 113.9 |
| R3 T13–14 | 12–24" | 29.0 | 13.91 | 91.9 |
| | 24–36" | 32.0 | 13.22 | 65.3 |
| Untreated | 0–12" | 29.0 | 11.44 | 57.8 |
| R5 T3–4 | 12–24" | 30.0 | 6.43 | −14.3 |
| | 24–36" | 31.0 | 6.57 | −15.2 |
| Untreated | 0–12" | 24.0 | 11.89 | 98.2 |
| R5 T16–17 | 12–24" | 27.0 | 11.18 | 65.6 |
| | 24–36" | 36.0 | 9.57 | 6.3 |
| Untreated | 0–12" | 30.0 | 18.87 | 151.6 |
| R5 T24–25 | 12–24" | 29.0 | 6.45 | −11.0 |
| | 24–36" | 34.0 | 7.88 | −7.3 |

Saturation %: Moisture percentage of a saturated soil paste, expressed on a dry-weight basis.
Moisture %: Moisture percentage lost in oven drying, expressed on a dry-weight basis.
Field Capacity: Moisture percentage of soil recently irrigated soil after drainage of excess water, expressed on a dry-weight basis. Equal to half the Saturation percentage.
Permanent Wilting Percentage of soil, expressed on a dry-weight basis, at which plants wilt and fail to recover turgidity. Equal to one fourth the Saturation percentage.
Available Moisture: Water in the soil available to plants. The range between Permanent Wilting percentage and Field Capacity.

It is to be understood that the term gypsum slurry as used herein includes undissolved gypsum mixed with water and the gypsum that is dissolved in water.

The process of this invention as hereinabove described may be operated in a variety of ways within the scope of this invention and with a variety of gypsum starting materials that are capable of being converted into slurry form and dissolved, and high purity powdery gypsum, above 90%, is particularly desirable.

I claim:

1. A process for continuously preparing a gypsum solution for use in fertilizing plants and trees comprising:

introducing ground powdered gypsum of about 100 mesh particle size and a purity of at least about 90% into a tank of water of sufficient depth to provide a mixing zone in a lower region thereof and having a restricted quiescent zone extending from an upper region of the tank to a substantial depth therein, vigorously agitating the mixture of gypsum and water in said lower region whereby some particles of the gypsum commence to go into solution and the remainder of the gypsum particles is formed into a slurry with the water, withdrawing the gypsum slurry with dissolved gypsum therein from the quiescent zone in the upper region of the tank while retaining in the bottom of the tank heavy insoluble components present in the granular gypsum feed, and introducing the gypsum slurry into an irrigation system under conditions to permit all gypsum particles to be dissolved prior to discharge of gypsum solution from the irrigation system to a plant area to be irrigated.

2. The process of claim 1 wherein mixing of powdered gypsum with water is enhanced through recirculation by withdrawing a portion of the gypsum slurry from an intermediate level in the tank, and returning that portion to the lower region of the tank for further vigorous agitation and mixing.

3. The process of claim 1 wherein mixing of powdered gypsum with water is enhanced through recirculation by withdrawing a portion of the gypsum slurry from an intermediate level in the tank, and returning that portion to the lower region of said mixing zone in the form of pressurized jet sprays to expedite dissolution of the gypsum by further agitation and mixing.

4. The process of claim 1 including adjusting relative quantities of (a) gypsum slurry formed in the mixing tank by the vigorous agitation of the gypsum and water, (b) said slurry that is recirculated and returned to said tank, and (c) the gypsum slurry delivered to the irrigation system so that the gypsum in the irrigation water at the point of delivery from the irrigation system to the plant area to be irrigated is substantially completely dissolved.

5. The process of claim 1 wherein gypsum introduced into the tank of water has a particle size of less than 100 mesh and insoluble impurities therein are less than 10 percent.

6. The process of claim 1 wherein the quiescent zone in the upper region of the tank is maintained by creating a zone in the upper region of the tank that is spaced from the mixing zone of the tank, passing the gypsum slurry through said quiescent zone and withdrawing said gypsum slurry from the top of said quiescent zone for further processing.

7. The process of claim 1 wherein the agitation of the gypsum slurry mix is carried out mechanically.

8. The process of claim 1 wherein the agitation of the gypsum slurry mix is carried out by hydraulic means in the form of pressurized liquid jets.

9. A process for continuously dissolving gypsum in water in an irrigation system comprising:

adding gypsum powder having a particle size substantially all of which is less than 100 mesh, said gypsum having a purity of at least about 92%;

adding said gypsum to a measured amunt of water continuously fed to a mixing tank while vigorously agitating the gypsum and water to form a gypsum and water slurry;

maintaining a quiescent zone within the mixing tank located adjacent the top of the slurry within the tank having a narrow cross-section relative to the horizontal cross-section of the tank and extending into the tank a sufficient depth so that agitation of the gypsum and water slurry in the tank is minimized and the gypsum and water slurry will enter the quiescent zone while larger gypsum particles remain in the area of the tank where vigorous mixing is taking place;

withdrawing a solution of gypsum and slurry from the tank at the top of the quiescent zone, separating said withdrawn solution to send a portion thereof to water flowing through an irrigation system where dissolution of said gypsum is substantially completed during the flow thereof to discharge outlets of the irrigation system.

10. The process of claim 9 wherein another portion of the gypsum slurry is separately withdrawn and recirculated to the mixing tank for further dissolution due to the agitation within the mixing zone.

11. A process for continuously preparing a gypsum solution for use in an irrigation system comprising:

introducing powdered gypsum of about 90% purity and 100 mesh particle size into a tank of irrigation water, said tank having a lower region and an upper region and being in communication with an irrigation system;

mixing the gypsum and water by vigorous agitation in said lower region to form a gypsum slurry and a solution of dissolved gypsum;

permitting said slurry and said solution to pass into a quiescent zone in the upper region of said tank as the gypsum continues to go into solution;

withdrawing said solution and said slurry through said quiescent zone; and returning said slurry and said gypsum to said irrigation system wherein substantially all of the gypsum particles in said slurry dissolved in the irrigation water while flowing through the irrigation system prior to discharge from the irrigation system.

* * * * *